US007696934B2

(12) United States Patent
Sato et al.

(10) Patent No.: US 7,696,934 B2
(45) Date of Patent: Apr. 13, 2010

(54) ANTENNA DEVICE, AND RADIO COMMUNICATION APPARATUS INCLUDING THE ANTENNA DEVICE

(75) Inventors: Katsuhiro Sato, Kani (JP); Fumihiro Sunda, Nagoya (JP); Shinichi Sakakibara, Toyoake (JP)

(73) Assignee: Brother Kogyo Kabushkik Kaisha, Nagoya (JP)

( * ) Notice: Subject to any disclaimer, the term of this patent is extended or adjusted under 35 U.S.C. 154(b) by 435 days.

(21) Appl. No.: 11/882,935

(22) Filed: Aug. 7, 2007

(65) Prior Publication Data

US 2008/0174497 A1 Jul. 24, 2008

(30) Foreign Application Priority Data

Jan. 22, 2007 (JP) ..... 2007-011951

(51) Int. Cl.
*H01Q 1/24* (2006.01)

(52) U.S. Cl. ..... 343/702

(58) Field of Classification Search ..... 343/702, 343/900, 700 MS
See application file for complete search history.

(56) References Cited

U.S. PATENT DOCUMENTS 5,539,417 A * 7/1996 Terry et al. ..... 343/702
5,760,745 A * 6/1998 Endo et al. ..... 343/702
5,966,097 A 10/1999 Fukasawa et al.
6,140,977 A * 10/2000 Morales et al. ..... 343/906
6,700,545 B2 3/2004 Hareyama
6,985,112 B2 1/2006 Sadamori et al.
7,109,948 B2 9/2006 Oyama et al.

FOREIGN PATENT DOCUMENTS

| | | |
|---|---|---|
| JP | U-61-62412 | 4/1986 |
| JP | U-7-20708 | 4/1995 |
| JP | A 9-326632 | 12/1997 |
| JP | A 10-93332 | 10/1998 |
| JP | A 2002-353718 | 12/2002 |
| JP | A-2003-158410 | 5/2003 |
| JP | A-2004-320075 | 11/2004 |
| JP | A-2004-336559 | 11/2004 |
| JP | A-2005-5954 | 1/2005 |

* cited by examiner

*Primary Examiner*—HoangAnh T Le
(74) *Attorney, Agent, or Firm*—Oliff & Berridge, PLC

(57) ABSTRACT

An antenna device built in a radio communication device, including a substrate having a support portion and a groove, and an electrically conductive elongate antenna member having first and second end portions, and wherein the elongate antenna member is supported at the first end portion by the support portion, and at least the second end portion of the elongate antenna member extends along the groove such that at least an extreme end of the second end portion is positioned within a depth of the groove.

21 Claims, 5 Drawing Sheets

FIG.1B
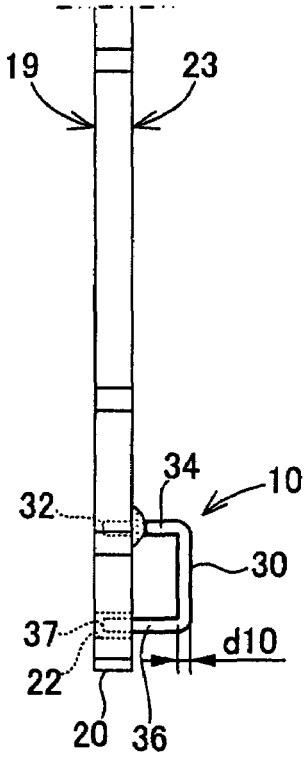
FIG.1A
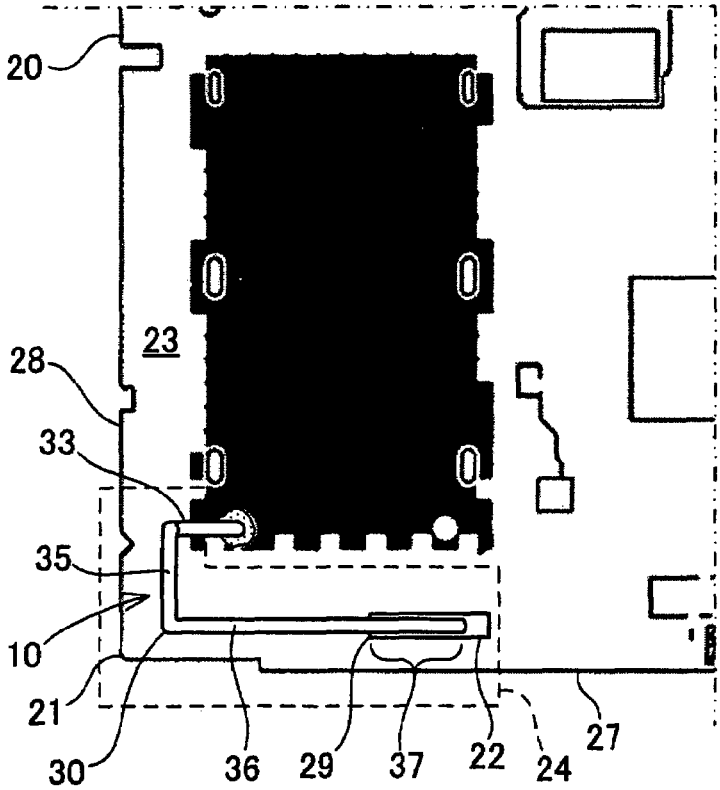
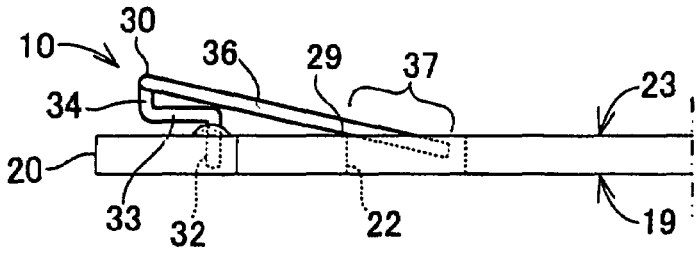
FIG.1C

FIG.3B
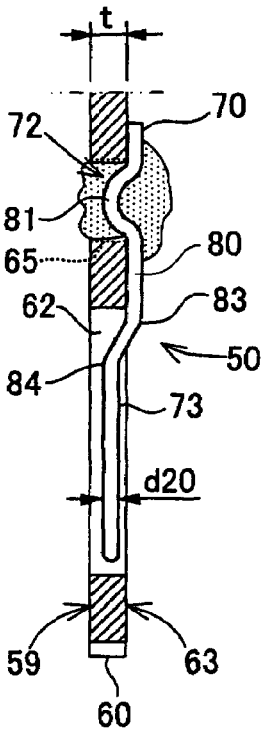
FIG.3A
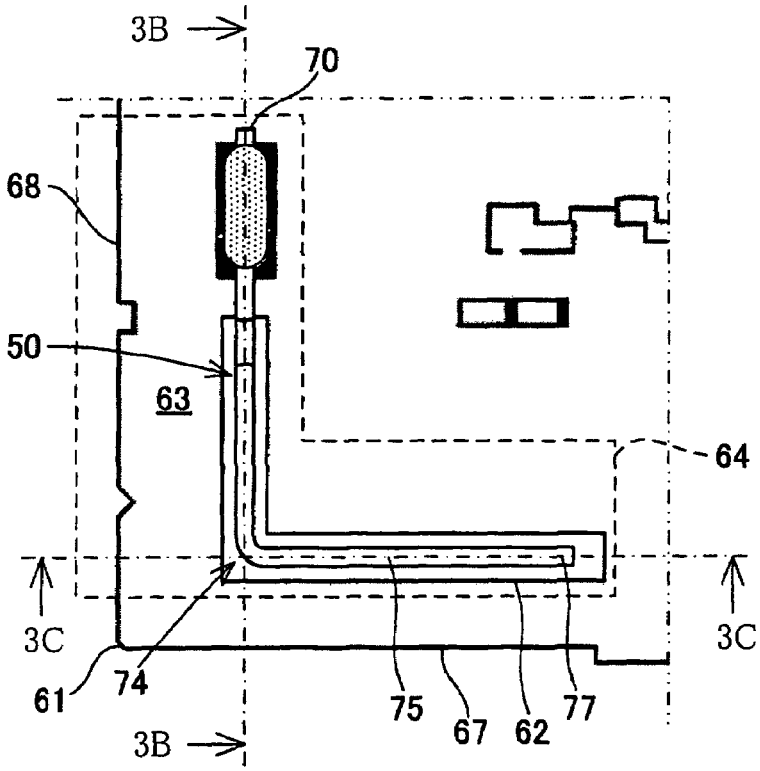
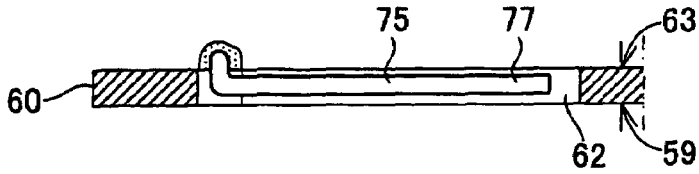
FIG.3C

ANTENNA DEVICE, AND RADIO COMMUNICATION APPARATUS INCLUDING THE ANTENNA DEVICE

CROSS REFERENCE TO RELATED APPLICATION

The present application claims the priority from Japanese Patent Application No. 2007-011951 filed Jan. 22, 2007, the disclosure of which is herein incorporated by reference in its entirety.

BACKGROUND OF THE INVENTION

1. Field of the Invention

The present invention relates in general to an antenna device used for a radio communication device, and more particularly to an antenna device built in the radio communication device.

2. Description of Related Art

Radio communication devices configured to effect radio communication through a radio wave, such as a telephone set and a mobile terminal, are provided with an antenna device. U.S. Pat. No. 5,966,097 (corresponding to JP-9-326632 A) discloses an example of a known antenna device built in a radio communication device. This type of antenna device includes an electrically conductive elongate or linear antenna member such as a piano wire (music wire) which is supported on a surface of an electrically conductive planar member, and is electrically connected to the electrically conductive planar member.

In the antenna device disclosed in the above-identified U.S. patent, the electrically conductive elongate or linear antenna member is exposed at its one end, and is therefore likely to catch or stick to a closing of a worker or a member surrounding the antenna device, when the antenna device is handled by the worker. Accordingly, the worker should take care to prevent the antenna device from catching the worker's closing or surrounding member.

SUMMARY OF THE INVENTION

The present invention was made in view of the background art described above. It is therefore a first object of the present invention to provide an antenna device which is easy to handle. A second object of the invention is to provide a radio communication device comprising such an antenna device.

The first object indicated above can be achieved according to a first aspect of this invention, which provides an antenna device built in a radio communication device, comprising: a substrate having a support portion and a groove; and an electrically conductive elongate antenna member having first and second end portions, and wherein the elongate antenna member is supported at the first end portion by the support portion, and at least the second end portion of the elongate antenna member extends along the groove such that at least an extreme end of the second end portion is at least partially positioned within a depth of the groove.

In the antenna device constructed as described above according to the first aspect of the present invention, the second end portion of the electrically conductive elongate antenna member is less likely to catch or stick to a closing of a worker or any member surrounding the antenna device, when the worker handles the antenna device. Accordingly, the present antenna device is easier to handle upon installation of the antenna device in or on a radio communication device, and the efficiency of assembling of the radio communication device is improved. Further, the provision of the groove makes it possible to reduce deterioration of characteristics (such as directivity, gain and radiation efficiency) of the antenna device due to the substrate, while permitting the electrically conductive elongate antenna member to be positioned within the surface area of the substrate.

In a first preferred form of the present invention, the groove is formed in a part of the substrate which is aligned with the second end portion of the elongate antenna member as viewed in a direction perpendicular to a plane of the substrate.

In the first preferred form of the invention, a radio wave radiated from the second end portion of the elongate antenna member propagates through the groove and is transmitted beyond the bottom or back surface of the substrate remote from the elongate antenna member, so that the attenuation of the radio wave radiated from at least the second end portion can be prevented.

In one advantageous arrangement of the first preferred form of the invention described above, the second end portion of the elongate antenna member is positioned within the groove. This arrangement effectively prevents the second end portion from catching or sticking to the worker's closing or any surrounding member.

Preferably, the groove is an elongate groove, and the second end portion of the elongate antenna member is held in abutting contact with an edge at one of two longitudinally opposite ends of the elongate groove. In this case wherein the second end portion is supported by the edge of the elongate groove, the second end portion can be held within the elongate groove with high stability.

In another advantageous arrangement of the first preferred form of this invention, the elongate antenna member further has an intermediate portion between the first and second end portions, and the intermediate portion is bent as viewed in the direction perpendicular to the plane of the substrate.

In a second preferred form of the present invention, the elongate antenna member further has an intermediate portion between the first and second end portions, and the groove is formed in a part of the substrate which is aligned with the intermediate portion as viewed in a direction perpendicular to a plane of the substrate.

In the second preferred form of the invention, not only the radio wave radiated from the second end portion of the elongate antenna member but also the radio wave radiated from the intermediate portion propagate through the groove and are transmitted beyond the back surface of the substrate, so that the attenuation of the radio wave radiated from not only the second end portion but also the intermediate portion can be prevented.

In one advantageous arrangement of the second preferred form of the invention, the intermediate portion of the elongate antenna member is bent as viewed in the plane perpendicular to the plane of the substrate. Accordingly, the intermediate portion can be positioned so as to extend along one side end face of the substrate which cooperates with another side end face to define a corner portion of the substrate, for example.

In another advantageous arrangement of the second preferred form of the invention, the intermediate portion is positioned within the groove. This arrangement effectively prevents not only the second end portion but also the intermediate portion from catching or sticking to the worker's closing or any surrounding member upon handling of the antenna device.

In the advantageous arrangement described just above, the intermediate portion is preferably located within the groove without a contact with inner surfaces of the groove. In this case, it is possible to prevent the attenuation of the radio wave due to the contact of the intermediate portion of the elongate antenna member with the inner surfaces of the groove.

In the advantageous arrangement described above, the elongate antenna member preferably includes: an outer portion located adjacent to the first end portion and externally of a surface of the substrate in which the groove is open; a first bent portion which is bent within the groove such that a portion of the elongate antenna member located on one of opposite sides of the second bent portion which is remote from the first bent portion extends parallel to the above-indicated surface of the substrate. In this case, the intermediate portion of the elongate antenna member can be adequately positioned with the groove.

In a third preferred form of the present invention, the substrate has a side end face perpendicular to a surface of the substrate in which the groove is open, and the groove is formed so as to extend along at least the side end face. In this form of the invention, a central part of the substrate can be effectively utilized for mounting electronic components, so that the freedom in layout of the electronic components is improved. Further, the substrate can be small-sized.

In one advantageous arrangement of the third preferred form of the invention, the groove is spaced from the above-indicated side end face of the substrate by a distance of not longer than 2 cm.

In a fourth preferred form of this invention, the substrate has a corner portion, and the groove is formed in the corner portion of the substrate. In this preferred form of the invention, the central part of the substrate can be effectively utilized for mounting the electronic components, so that the freedom in layout of the electronic components is improved, Further, the corner portion of the substrate can be effectively utilized for mounting the elongate antenna member, so that the substrate can be small-sized.

In one advantageous arrangement of the fourth preferred form of the invention, the substrate has two adjacent side end faces defining the corner portion and perpendicular to a surface of the substrate in which the groove is open, and the elongate antenna member includes a portion extending along the two adjacent side end faces and is generally L-shaped as viewed in a direction perpendicular to a plane of the substrate.

In a fifth preferred form of this invention, the groove is a though-hole formed through an entire thickness of the substrate. In this preferred form of the invention, the attenuation of the radio wave in the presence of the substrate can be prevented, and the deterioration of the characteristics of the antenna device due to the substrate can be reduced.

In a sixth preferred form of the present invention, the substrate includes an electrically conductive portion and a non-electrically-conductive portion, and the elongate antenna member is located in an area of the non-electrically-conductive portion of the substrate. In this preferred form of the invention, an influence of the electrically conductive portion of the substrate on the antenna device can be reduced, and the deterioration of the characteristics of the antenna device due to the electrically conductive portion can be reduced.

In one advantageous arrangement of the sixth preferred form of the invention, the elongate antenna member is spaced from the electrically conductive portion by a distance not shorter than one wavelength of a radio wave used by the radio communication device.

In a seventh preferred form of the present invention, the substrate is provided with at least one electronic component mounted in an area of a surface thereof which area surrounds the elongate antenna member, the at least one electronic component including a component having a height from the above-indicated surface, which height is larger than a maximum height of the elongate antenna member. In this preferred form of the invention, the elongate antenna member does not protrude beyond the upper end of the highest electronic component, and is therefore unlikely to catch or stick to the worker's closing or any surrounding member.

The second object indicated above can be achieved according to a second aspect of this invention, which provides a radio communication device including an antenna device constructed according to the first aspect of the invention described above.

The radio communication device including the antenna device described above has substantially the same advantages as described above with respect to the antenna device according to the first aspect of the invention.

BRIEF DESCRIPTION OF THE DRAWINGS

The above and other objects, features, advantages and technical and industrial significance of the present invention will be better understood by reading the following detailed description of preferred embodiments of the present invention, when considered in connection with the accompanying drawings, in which:

FIG. 1A is a plan view of an antenna device constructed according to a first embodiment of this invention, and FIGS. 1B and 1C are side elevational views of the antenna device;

FIG. 3A is a plan view of an antenna device constructed according to a second embodiment of this invention, and FIG. 3B is an elevational view in cross section taken along line 3B-3B of FIG. 3A, while FIG. 3C is an elevational view in cross section taken along line 3C-3C of FIG. 3A;

DETAILED DESCRIPTION OF THE PREFERRED EMBODIMENTS

Figure 2:
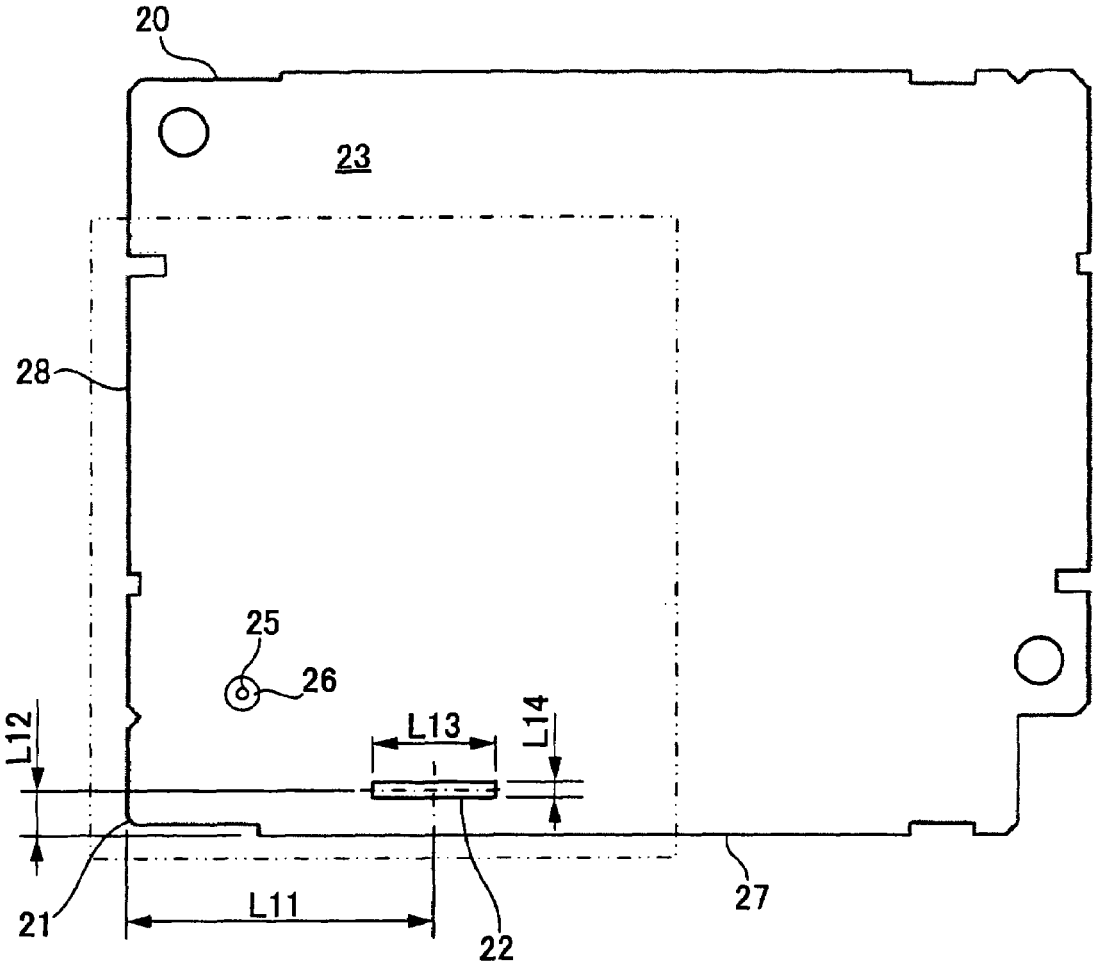
FIG. 2 is a plan view of a substrate on which the antenna device of FIGS. 1A-1C are mounted.

Referring to the drawings, the preferred embodiments of this invention will be described in detail. It is to be understood that the following preferred embodiments are given for illustrative purpose only, and may be modified as needed, without departing from the sprit of the present invention.

First Embodiment

Referring first to FIGS. 1A, 1B and 1C, and FIG. 2, there is shown an antenna device 10 which is constructed according to the first embodiment of this invention and which includes a substrate 20. It is noted that FIGS. 1A, 1B and 1C show a portion of the substrate 20 which is located within an area indicated by two-dot chain line in FIG. 2.

The antenna device 10 further includes an electrically conductive elongate antenna member in the form of a linear conductor 30 which is supported by the substrate 20. As shown in FIG. 2, the substrate 20 has a generally rectangular shape. As shown in FIG. 1A, a linear conductor 30 is positioned within a corner portion 24 (indicated by dashed line) of the substrate 20. The corner portion 24 is located adjacent to one corner 21 of the substrate 20.

The substrate 20 is a so-called printed-wiring board, which is a planar body formed of a dielectric material (a non-electrically-conductive portion) having a wiring pattern (an electrically conductive portion) which is not shown in FIGS. 1 and 2. The substrate 20 has a top or upper surface 23 on which there are mounted a power supply portion for power supply to the linear conductor 30, and various kinds of electronic components for radio communication, as well as the linear conductor 30. In the present embodiment, the antenna device 10 and the substrate cooperate to constitute a control board for the radio communication. The control board is used for a radio communication device such as a telephone set configured to effect radio communication through a radio wave, and a facsimile device configured to effect radio communication with the telephone set, for example.

The substrate 20 has a groove in the form of an elongate hole 22 formed through the entire thickness defined by the top surface 23 and a bottom or lower surface 19. As shown in FIG. 2, the elongate hole 22 has a width L14 of 1 mm, and a length L13 of 8 mm, for example. The elongate hole 22 has a center point which is spaced from a side end face 27 of the substrate 20 by a distance L12 of 4 mm, and from a side end face 28 of the substrate 20 by a distance L11 of 27.8 mm. In other words, the elongate hole 22 is formed adjacent to the side end face 27, preferably, spaced from the side end face 27 by a distance of not longer than 2 cm. The two side end faces 27, 28 are perpendicular to the top and bottom surfaces 23, 19 and cooperate to define the corner 21 indicated above. The elongate hole 22 may be replaced by a groove which is open in only one of the top and bottom surfaces 23, 19, that is, which is not formed through the entire thickness of the substrate 20.

As shown in FIG. 2, the substrate has a support portion in the form of a through-hole 25 formed through the entire thickness and open in the top and bottom surfaces 23, 19. The through-hole 25 is electrically connected to the above-indicated power supply portion on provided the substrate 20. Around the upper open end of the through-hole 25, there is formed an annular land 26, as shown in FIG. 2. The linear conductor 30 has a first end portion in the form of a proximal end portion 32 which is inserted in the through-hole 25 and fixed therein by a solder applied to the annular land 26, so that the linear conductor 30 is supported at the proximal end portion 32 by the through-hole 25 and is held electrically connected to the power supply portion.

For example, the linear conductor 30 is formed from an electrically conductive metallic wire having a diameter d1 smaller than the width L14 of the elongate hole 22. In the present example wherein the width L14 is 1 mm, the linear conductor 30 is formed from a wire having the diameter d1 of about 0.5 mm.

The linear conductor 30 further has a first parallel straight portion 33, a perpendicular straight portion 34, a second straight portion 35, an inclined straight portion 36, and a second end portion in the form of a distal end portion 37. The first and second parallel straight portions 33, 35 are parallel to the top surface 23 of the substrate 20, while the perpendicular straight portion 34 is perpendicular to the top surface 23. The inclined straight portion 36 is inclined with respect to the top surface 23. The first parallel straight portion 33 extends from the upper end of the proximal end portion 32 in the direction parallel to the side end face 27 toward the side end face 28. The perpendicular straight portion 34 connects the first and second parallel straight portions 33, 35, and the second parallel straight portion 35 extends from the upper end of the perpendicular straight portion 34 in the direction parallel to the side end face 28 toward the side end face 27. The inclined straight portion 36 extends in the direction parallel to the side end face 27 toward the elongate hole 22.

The second parallel straight portion 35 has a height from the top surface 23, which is not larger than a height of the highest one of the at least one electronic component mounted adjacent to the linear conductor 30, more precisely, mounted in the corner portion 24 of the top surface 23, which corner portion 24 surrounds the linear conductor 30. The distal end portion 37 of the linear conductor 30 has an extreme end positioned within a depth of the elongate hole 22. Namely, the extreme end does not project beyond the bottom surface 19 of the substrate 20. As shown in FIG. 1A, the inclined straight portion 36 and the distal end portion 37 extend in the longitudinal direction of the elongate hole 22. In other words, the elongate hole 22 is formed in a part of the substrate 20 which is aligned with the distal end portion 37 of the linear conductor 30 as viewed in a direction perpendicular to the lane of the substrate 20.

The distal end portion 37 is held in abutting contact with one 29 of upper longitudinally opposite edges of the elongate hole 22, namely the upper edge 29 at one of the two longitudinally opposite ends of the elongate groove 22. Described in detail, the distal end portion 37 is biased by elasticity of the linear conductor 30 toward the top surface 23 of the substrate 20, whereby the distal end portion 37 is held in abutting contact with the upper edge 29 of the elongate hole 22.

The corner portion 24 of the substrate 20 in which the linear conductor 30 is positioned is not provided with an electrically conductive member except the through-hole 25 and annular land 26. That is, the wiring pattern is not formed in an area of an electrically conductive portion of the substrate 20 in which the linear conductor 30 is located, that is, formed in an area of the dielectric or non-electrically-conductive portion of the substrate 20. Preferably, the linear conductor 30 is spaced from the electrically conductive portion by a distance not shorter than one wavelength of the radio wave used by the radio communication device.

The antenna device 10 constructed as described above have the following advantages. Namely, the distal end portion 37 of the linear conductor 30 is located within the depth of the elongate hole 22, so that the distal end portion 37 does not catch or stick to a closing of the worker or any member surrounding the antenna device 10, when the worker installs the antenna device 10 in or on the radio communication device. Accordingly, a risk of damaging the antenna device 10 upon assembling of the radio communication device is favorably reduced, and the antenna device 10 is easier to handle, leading to improved efficiency of assembling of the radio communication device.

The present embodiment is further arranged such that the radio wave radiated from the distal end portion 37 propagates through the elongate hole 22 and is transmitted beyond the bottom surface 19, so that the attenuation of at least the radio wave radiated from the distal end portion 37 can be prevented. Although the elongate hole 22 is formed in the part of the substrate 10 aligned with the distal end portion 37 as viewed in the direction perpendicular to the plane of the substrate 10, additional elongate holes may be formed in respective parts of the substrate 10 which are aligned with the second parallel straight portion 35 and the inclined straight portion 36. The modification permits transmission of the radio waves radiated from only the distal end portion 37 but also the straight portions 35, 36 beyond the bottom surface 19 of the substrate 20 through not only the elongate hole 22 but also the additional elongate holes.

The present embodiment is also arranged such that the distal end portion 37 of the linear conductor 30 is held in abutting contact with the edge 29 of the elongate hole 22, so that the distal end portion 37 can be held within the elongate hole 22 with high stability.

The present embodiment is further arranged such that the elongate hole 22 and the linear conductor 30 are located adjacent to the side end face 27 of the substrate 20, so that a central part of the substrate 20 can be effectively utilized for mounting the electronic components. Thus, the freedom in layout of the electronic components is improved. Further, the substrate 20 can be small-sized.

The present embodiment is further arranged such that the corner portion 24 of the substrate 20 is formed of the dielectric or non-electrically-conductive material, so that the deterioration of the characteristics of the antenna device 10 due to the wiring pattern or any other electrically conductive material can be effectively reduced.

The present embodiment is also arranged such that the height of the second parallel straight portion 35 which is the highest portion of the linear conductor 30 from the surface 23 is not larger than the height of the highest one of the electronic components mounted in the area of the substrate 20 which is relatively near the linear conductor 30. Accordingly, the linear conductor 30 is protected against contact with any member surrounding the antenna device 10.

Second Embodiment

Figure 4:
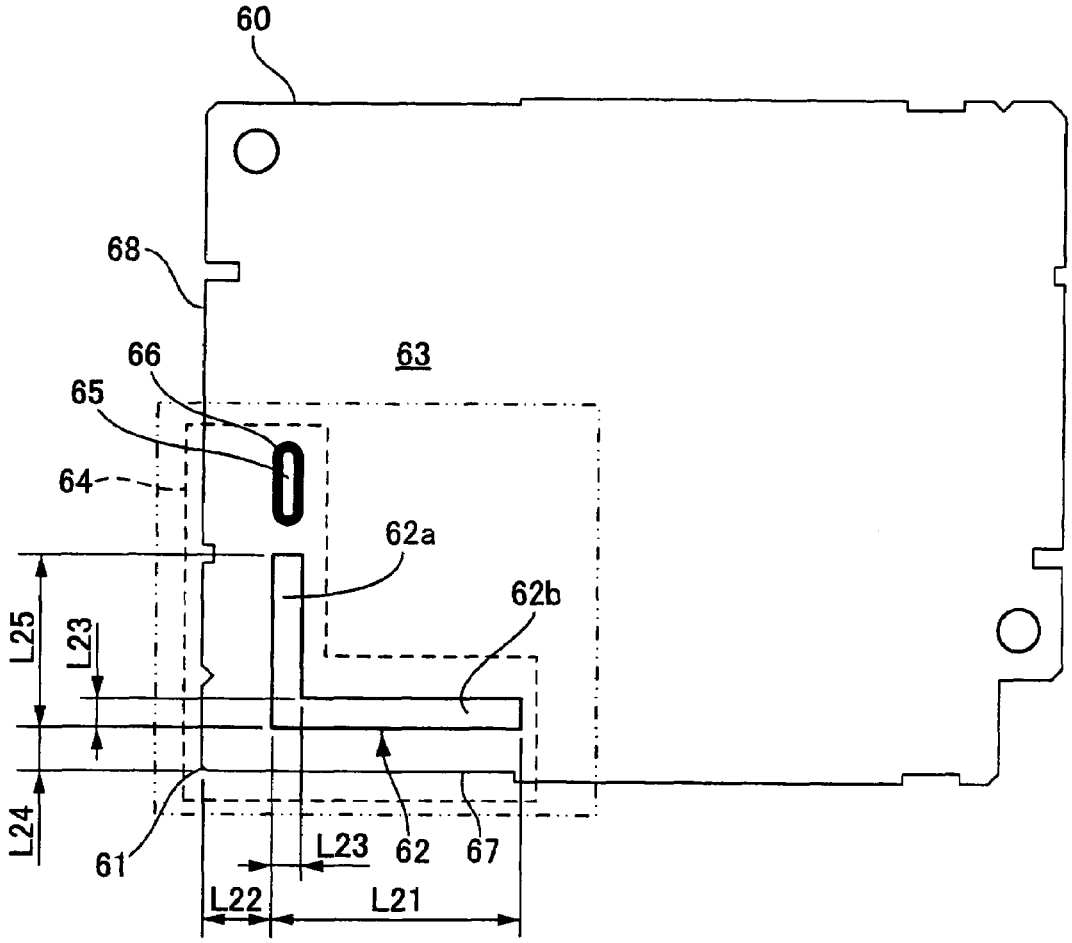
FIG. 4 is a plan view of a substrate on which the antenna device of FIGS. 3A-3C is mounted.

Referring next to FIGS. 3-5, there will be described an antenna device 50 which is constructed according to the second embodiment of the present invention and which includes a substrate 60. It is noted that FIGS. 3A, 3B and 3C show a portion of the substrate 60 which is located within an area indicated by two-dot chain line in FIG. 4.

The antenna device 50 further includes an electrically conductive elongate antenna member in the form of a linear conductor 70 which is supported by the substrate 60. As shown in FIG. 3, the substrate 60 has a generally rectangular shape. As shown in FIG. 3A, a linear conductor 70 is positioned within a corner portion 64 (indicated by dashed line) of the substrate 60. The corner portion 64 is located adjacent to one corner 61 of the substrate 60.

Like the substrate 20 in the first embodiment, the substrate 60 is a so-called printed-wiring board, which is a planar body formed of a dielectric material (a non-electrically-conductive portion) having a wiring pattern (an electrically conductive portion) which is not shown in FIGS. 3 and 4. The substrate 60 has a thickness t equal to or larger than a diameter d20 of the linear conductor 70. The substrate 60 has a top or upper surface 63 in which there is formed a support portion in the form of a through-hole 65. As shown in FIG. 4, the through-hole 65 is an elongate hole extending along a side end face 68 of the substrate 60. Around the upper open end of the through-hole 65, there is formed an annular land 66, as shown in FIG. 4. The annular land 66 is electrically connected to a power supply portion provided on the substrate 60. The linear conductor 70 has a first end portion in the form of a proximal end portion 72 which is inserted in the through-hole 65 and fixed therein by a solder applied to the annular land 66, so that the linear conductor 70 is supported at the proximal end portion 72 by the through-hole 65 and is held electrically connected to the power supply portion.

The substrate 60 has a generally L-shaped groove 62 formed through its entire thickness such that the groove 62 is open in the top or upper surface 63 and a bottom or lower surface 59. Described in detail, the groove 62 consists of a first straight portion 62*a* and a second straight portion 62*b*, as shown in FIG. 4. The first straight portion 62*a* extends along the side end face 68 from a point near the annular land 66 toward a side end face 67 of the substrate 60, which is perpendicular to the side end face 68. The second straight portion 62*b* extends along the side end face 67 from the end of the first straight portion 62*a* remote from the annular land 66. The two side end faces 67, 68 cooperate to define the corner 61 of the substrate 60. For example, the groove 62 has a width L23 of 3 mm, and the first straight portion 62*a* has a length L25 of 17.5 mm while the second straight portion 62*b* has a length L21 of 25.5 mm. The first straight portion 62*a* is spaced from the side end face 68 by a distance L22 of 5 mm, while the second straight portion 62*b* is spaced from the side end face 67 by a distance of L24 of 4.5 mm. In other words, the generally L-shaped groove 62 is formed adjacent to the corner 61, so as to extend along the two side end faces 67, 68 of the substrate 60. Although the groove 62 is a through-hole, the groove 62 may be replaced by a groove which is open in only one of the top and bottom surfaces 63, 59 and which is not formed through the entire thickness of the substrate 60.

For example, the linear conductor 70 is formed from an electrically conductive metallic wire, and is generally L-shaped, as shown in FIG. 3A. The linear conductor 70 consists of the first end portion in the form of the proximal end portion 72, a first straight portion 73, a curved portion 74, a second straight portion 75, and a second end portion in the form of a distal end portion 77. The first and second straight portions 73, 75 are straight as seen in the planes of FIGS. 3A and 3B. The first and second straight portions 73, 75 and the curved portion 74 cooperate to constitute an intermediate portion. In the present second embodiment, the linear conductor 70 is supported on the substrate 60 such that the intermediate portion 73-75 and the distal end portion 77 are positioned within a depth of the generally L-shaped groove 62, as shown in FIGS. 3B and 3C. Namely, the groove 62 is formed in a portion of the surface 63 of the substrate 60 which is aligned with the linear conductor 63 as viewed in a direction perpendicular to the plane of the substrate 60.

Figure 5B:
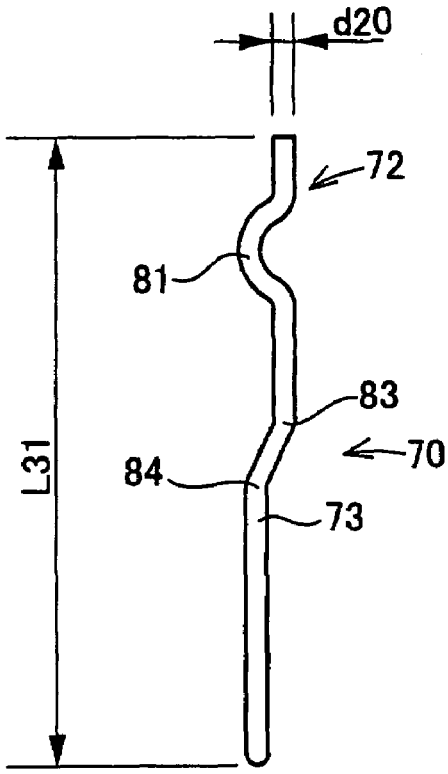
FIGS. 5A and 5B are views showing a linear conductor of the antenna device of FIGS. 3A-3C.
Figure 5A:
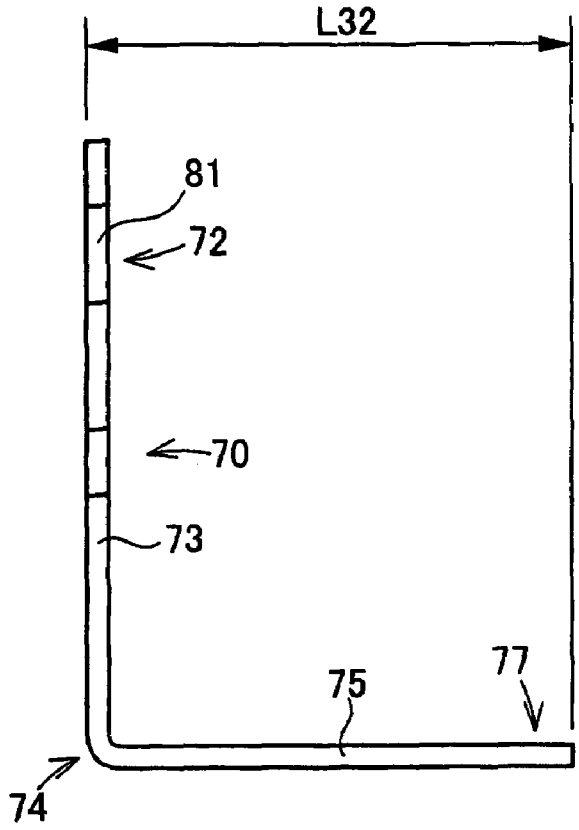

The linear conductor 70 is formed from a wire having a diameter smaller than the width L24 of the groove 62. In the present example wherein the width L23 of the groove 62 is 3 mm, the linear conductor 70 is formed from a wire having the diameter d20 of about 11.0 mm. As indicated in FIGS. 5A and 5B, the linear conductor 70 has a length L31 of 29.0 mm from the extreme end of the proximal end portion 72 to the curved portion 74, and a length L32 of 22.5 mm from the curved portion 74 to the extreme end of the distal end portion 77.

The proximal end portion 72 has a generally arcuate part 81 positioned within the through-hole 65 and fixed therein with a solder applied to the annular land 66, so that the linear conductor 70 is securely supported at its proximal end portion 72 by the through-hole 65, and is held electrically connected to the power supply portion.

As shown in FIG. 3B, the first straight portion 73 which extends straight as seen in the plane of FIG. 3A includes (a) an outer portion 80 located adjacent to the proximal end portion 72 and externally of the surface 63 of the substrate 60, (b) a first bent portion 83 which is bent from the outer portion 80 into the groove 62, (c) and a second bent portion 84 which is bent within the groove 62 such that a portion of the first straight portion 73 which is located on one of opposite sides of the second bent portion 84 remote from the first bent portion extends parallel to the surface 63 of the substrate 60. Accordingly, the first straight portion 73, curved portion 74, second straight portion 75 and the distal end portion 77 are positioned within the depth of the generally L-shaped groove 62.

As shown in FIG. 4, the corner portion 64 of the substrate 60 in which the linear conductor 70 is positioned is not provided with an electrically conductive member except the annular land 66. That is, the wiring pattern is not formed in an area of an electrically conductive portion of the substrate 60 in which the linear conductor 70 is located, that is, formed in an area of the dielectric or non-electrically-conductive portion of the substrate 60. Preferably, the linear conductor 60 is spaced from the electrically conductive portion by a distance not shorter than one wavelength of the radio wave used by the radio communication device.

The antenna device 50 constructed as described above according to the second embodiment of the invention have the following advantages. Namely, the intermediate portion 73-75 and the distal end portion 77 of the linear conductor 70 are located within the depth of the generally L-shaped groove 62, so that the linear conductor 70 does not catch or stick to a closing of the worker or any member surrounding the antenna device 10, when the worker installs the antenna device 50 in or on the radio communication device. Accordingly, a risk of damaging the antenna device 50 upon assembling of the radio communication device is favorably reduced, and the antenna device 50 is easier to handle, leading to improved efficiency of assembling of the radio communication device. In the present second embodiment, the intermediate portion 73-75 and the distal end portion 77 are positioned within the groove 62, only the distal end portion 77 or only the second straight portion 75 and the distal end portion 77 may be positioned within the groove 62. Further, the entire diameter of the intermediate portion 73-75 and the distal end portion 77 need not be positioned within the depth of the groove 73. That is, only a portion of the diameter may be positioned within the depth of the groove 73.

The present second embodiment is further arranged such that the radio wave radiated from the linear conductor 70 propagates through the groove 62 and is transmitted beyond the bottom surface 59 of the substrate 60, so that the attenuation of the radiated radio wave can be prevented.

The present second embodiment is further arranged such that the groove 62 and the linear conductor 70 are located adjacent to the corner 61 of the substrate 60, so that a central part of the substrate 60 can be effectively utilized for mounting the electronic components. Thus, the freedom in layout of the electronic components is improved. Further, the substrate 60 can be small-sized.

The second embodiment is further arranged such that the corner portion 64 of the substrate 60 is formed of the dielectric or non-electrically-conductive material, so that the deterioration of the characteristics of the antenna device 50 due to the wiring pattern or any other electrically conductive material can be effectively reduced.

What is claimed is:

1. An antenna device built in a radio communication device, comprising:

a substrate having a support portion and a groove; and an electrically conductive elongate antenna member having first and second end portions, and wherein the elongate antenna member is supported at the first end portion by the support portion, and at least the second end portion of the elongate antenna member extends along the groove such that at least an extreme end of the second end portion is at least partially positioned within a depth of the groove.

2. The antenna device according to claim 1, wherein the groove is formed in a part of the substrate which is aligned with the second end portion of the elongate antenna member as viewed in a direction perpendicular to a plane of the substrate.

3. The antenna device according to claim 2, wherein the second end portion of the elongate antenna member is positioned within the groove.

4. The antenna device according to claim 3, wherein the groove is an elongate groove, and the second end portion of the elongate antenna member is held in abutting contact with an edge at one of two longitudinally opposite ends of the elongate groove.

5. The antenna device according to claim 2, wherein the elongate antenna member further has an intermediate portion between the first and second end portions, and the intermediate portion is bent as viewed in said direction.

6. The antenna device according to claim 1, wherein the elongate antenna member further has an intermediate portion between the first and second end portions, and the groove is formed in a part of the substrate which is aligned with the intermediate portion as viewed in a direction perpendicular to a plane of the substrate.

7. The antenna device according to claim 6, wherein the intermediate portion of the elongate antenna member is bent as viewed in said direction.

8. The antenna device according to claim 6, wherein the intermediate portion is positioned within the groove.

9. The antenna device according to claim 8, wherein the intermediate portion is located within the groove without a contact with inner surfaces of the groove.

10. The antenna device according to claim 8, wherein the elongate antenna member includes:

an outer portion located adjacent to the first end portion and externally of a surface of the substrate in which the groove is open;

a first bent portion which is bent from the outer portion into the groove; and a second bent portion which is bent within the groove such that a portion of the elongate antenna member located on one of opposite sides of the second bent portion which is remote from the first bent portion extends parallel to said surface of the substrate.

11. The antenna device according to claim 1, wherein the substrate has a side end face perpendicular to a surface of the substrate in which the groove is open, and the groove is formed so as to extend along at least the side end face.

12. The antenna device according to claim 11, wherein the groove is spaced from said side end face of the substrate by a distance of not longer than 2 cm.

13. The antenna device according to claim 1, wherein the substrate has a corner portion, and the groove is formed in the corner portion of the substrate.

14. The antenna device according to claim 13, wherein the substrate has two adjacent side end faces defining the corner portion and perpendicular to a surface of the substrate in which the groove is open, and the elongate antenna member includes a portion extending along the two adjacent side end faces and is generally L-shaped as viewed in a direction perpendicular to a plane of the substrate.

15. The antenna device according to claim 1, wherein the groove is a through-hole formed through an entire thickness of the substrate.

16. The antenna device according to claim 1, wherein said substrate includes an electrically conductive portion and a non-electrically-conductive portion, and said elongate antenna member is located in an area of the non-electrically-conductive portion of the substrate.

17. The antenna device according to claim 16, wherein the elongate antenna member is spaced from the electrically conductive portion by a distance not shorter than one wavelength of a radio wave used by the radio communication device.

18. The antenna device according to claim 1, wherein the substrate is provided with at least one electronic component mounted in area of a surface thereof which area surrounds said elongate antenna member, said at least one electronic component including a component having a height from said surface, which height is larger than a maximum height of said elongate antenna member.

19. A radio communication device comprising an antenna device defined in claim 1.

20. A radio communication device comprising an antenna device defined in claim 3.

21. A radio communication device comprising an antenna device defined in claim 9.

* * * * *

UNITED STATES PATENT AND TRADEMARK OFFICE

CERTIFICATE OF CORRECTION

PATENT NO. : 7,696,934 B2
APPLICATION NO. : 11/882935
DATED : April 13, 2010
INVENTOR(S) : Katsuhiro Sato et al.

It is certified that error appears in the above-identified patent and that said Letters Patent is hereby corrected as shown below:

Title Page please delete the following:

"(73) Assignee: Brother Kogyo Kabushkik Kaisha, Nagoya (JP)"

and replace with:

--(73) Assignee: Brother Kogyo Kabushiki Kaisha, Nagoya (JP)--

Signed and Sealed this

Twenty-second Day of June, 2010

David J. Kappos

David J. Kappos
*Director of the United States Patent and Trademark Office*